US005495832A

United States Patent [19]

Fujii et al.

[11] Patent Number: 5,495,832

[45] Date of Patent: Mar. 5, 1996

[54] VALVE OPERATING DEVICE FOR INTERNAL COMBUSTION ENGINE

[75] Inventors: Noriaki Fujii; Ichirou Ohmura, both of Saitama, Japan

[73] Assignee: Honda Giken Kogyo Kabushiki Kaisha, Tokyo, Japan

[21] Appl. No.: 292,690

[22] Filed: Aug. 18, 1994

[30] Foreign Application Priority Data

Aug. 19, 1993 [JP] Japan ..... 5-204985

[51] Int. Cl.[6] ..... F01L 13/00

[52] U.S. Cl. ..... 123/90.16; 123/90.22

[58] Field of Search ..... 123/90.15, 90.16, 123/90.17, 90.22, 90.27, 90.39, 90.44; 74/568 R

[56] References Cited

U.S. PATENT DOCUMENTS

| | | | |
|---|---|---|---|
| 4,777,914 | 10/1988 | Konno | 123/90.16 |
| 4,887,563 | 12/1989 | Ishida et al. | 123/90.16 |
| 5,207,193 | 5/1993 | Sugimoto et al. | 123/90.27 |

FOREIGN PATENT DOCUMENTS

| | | |
|---|---|---|
| 0259106 | 3/1988 | European Pat. Off. . |
| 36801 | 2/1991 | Japan . |
| 2197686 | 5/1988 | United Kingdom . |

*Primary Examiner*—Weilun Lo
*Attorney, Agent, or Firm*—Lyon & Lyon

[57] ABSTRACT

An internal combustion engine intake valve operating mechanism for two intake valves having a separate driving rocker arm for each valve and two free rocker arms not connected to the intake valves. In a low-speed operating range, the driving rocker arms are in their disconnecting states from the free rocker arms, so that both intake valves are opened and closed by a second cam and a fourth cam. In a medium-speed operating range, the first free rocker arm and the first driving rocker arm are interconnected, so that one of the intake valves is opened and closed by a first cam and the other intake valve continues to be opened and closed by the fourth cam. In a high-speed operating range, the first driving rocker arm, the second free rocker arm and the second driving rocker arm are connected to one another, so that both the intake valves are opened and closed by a third cam. This reduces the equivalent inertial mass during connection of rocker arms and enables an increase in output and a reduction in fuel consumption in an internal combustion engine operating in multi-stages depending upon operating conditions of the engine.

6 Claims, 11 Drawing Sheets

VALVE OPERATING DEVICE FOR INTERNAL COMBUSTION ENGINE

The present invention relates to a valve operating device for use in an internal combustion engine for varying operating characteristics of a pair of engine valves in multi-stages depending upon operating conditions of the engine.

Such valve operating devices have been already known, for example, from Japanese Utility Model Publication No. 6801/91 and the like.

In the above prior art device, four cams having different profiles are provided to come into sliding contact with four rocker arms disposed adjacent one another, including two rocker arms independently operatively connected to a pair of intake valves, so that the connection and disconnection of adjacent rocker arms can be switched from each other, and the operating characteristics of the pair of intake valves can be switched through at least four or more stages. However, the rocker arm corresponding to the high-speed cam having the profile corresponding to the high-speed operating range of the engine is disposed at one end of the arrangement of adjoining rocker arms, so that both the intake valves are opened and closed by the high-speed cam in a condition in which all the rocker arms have been connected together in the high-speed operating range of the engine. For this reason, during operation of the engine at a high speed, the equivalent inertial mass of all the rocker arms is increased. If the spring constant of a valve spring for biasing the engine valve in a closing direction is set at a value suitable for the low-speed operating range in which the rocker arms are not connected, the bounce revolution-number, which is the lower limit number of revolutions of an engine which permits the engine valve to be reopened after full seating, is reduced to cause degradation of output and fuel consumption in the high-speed operating range. If the spring constant of the valve spring is set at a large value to avoid the reduction in the bounce revolution-number, the valve-operating friction is increased in the low-speed operating range of the engine to cause a mechanical pumping loss.

The present invention has been accomplished with such circumstance in view, and it is an object of the present invention to provide a valve operating device for use in an internal combustion engine, wherein not only in the high-speed operating range but also in the medium-speed operating range of the engine, the equivalent inertial mass of the pivoting rocker arms can be reduced relatively by a combination of a required minimal number of rocker arms, thereby enabling an improvement in output and a reduction in fuel consumption.

To achieve the above object, according to the present invention, there is provided a valve operating device for use in an internal combustion engine for varying operating characteristics of a pair of engine valves in multi-stages depending upon operating conditions of the engine, said device comprising a cam shaft which is provided with a first cam having a profile corresponding to a medium-speed operating range of the engine, a second cam having a profile corresponding to a low-speed operating range of the engine, a third cam having a profile corresponding to a high-speed operating range of the engine, and a fourth cam having a profile corresponding to low- and medium-speed operating ranges of the engine, said four cams being successively arranged in this order on the cam shaft; a rocker shaft which is provided with a first free rocker arm in sliding contact with the first cam, a first driving rocker arm operatively connected to one of the engine valves and disposed adjacent one side of the first free rocker arm to be in sliding contact with the second cam, a second free rocker arm disposed adjacent one side of the first driving rocker arm to be in sliding contact with the third cam, and a second driving rocker arm operatively connected to the other engine valve and disposed adjacent one side of the second free rocker arm to be in sliding contact with the fourth cam, said four rocker arms being commonly carried on said rocker shaft for relatively swinging movements; a medium-speed switching pin fitted in the first free rocker arm for movement between a position to interconnect the first free rocker arm and the first driving rocker arm in the medium-speed operating range of the engine and a position to disconnect the first free rocker arm and the first driving rocker arm from each other in the low-and high-speed operating ranges of the engine; a first high-speed switching pin fitted into the second driving rocker arm for swinging movement between a position to interconnect the second driving rocker arm and the second free rocker arm in the high-speed operating range of the engine and a position to disconnect the second driving rocker arm and the second free rocker arm from each other in the low- and medium-speed operating ranges of the engine; a second high-speed switching pin operatively engaging the first high-speed switching pin and fitted into the second free rocker arm for swinging movement between a position to interconnect the second free rocker arm and the first driving rocker arm in the high-speed operating range of the engine and a position to disconnect the second free rocker arm and the first driving rocker arm in the low- and medium-speed operating ranges of the engine; and a resilient mechanism provided on the first driving rocker arm and interposed between the medium-speed switching pin and the second high-speed switching pin to exhibit a resilient force for biasing the medium-speed switching pin as well as the first and second high-speed switching pins toward their disconnecting positions whereby the medium-speed switching pin is fitted into the first driving rocker arm when the first and second high-speed switching pins are in their disconnecting positions, as well as to permit the second high-speed switching pin to be fitted into the first driving rocker arm when the medium-speed switching pin is in its disconnecting position.

The present invention will now be described by way of a preferred embodiment in connection with the accompanying drawings wherein.

Figure 1:
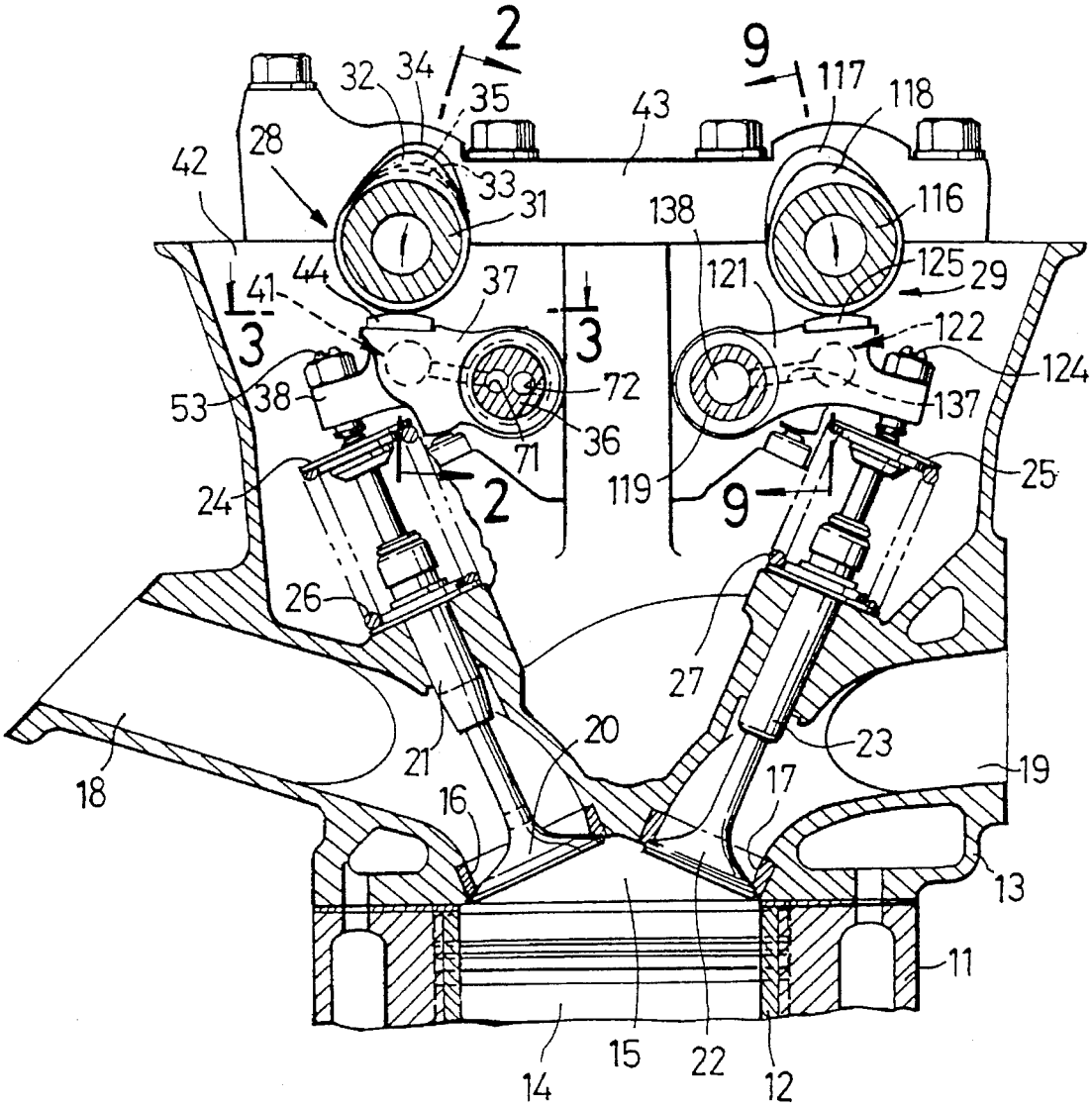
FIG. 1 is a vertical sectional view of the valve operating portion of an internal combustion engine.

FIGS. 1 to 10 illustrate a first embodiment of the present invention. Referring first to FIG. 1, in a DOHC type multi-cylinder internal combustion engine, a plurality of cylinders 12 are provided in a series arrangement within a cylinder block 11. A combustion chamber 15 is defined between a cylinder head 13 coupled to an upper end of the cylinder block 11 and a piston 14 which is slidably received in each of the cylinders 12. The cylinder head 13 has a pair of intake valve bores 16, 16 and a pair of exhaust valve bores 17, 17 provided in an area forming a ceiling surface of each of the combustion chambers 15. The cylinder head 13 is provided with an intake port 18 which opens into one side of the cylinder head 13 to communicate with both the intake valve bores 16, 16. The cylinder head 13 is also provided with an exhaust port 19 which opens into the other side of the cylinder head 13 to communicate with both the exhaust valve bores 17, 17.

A pair of guide sleeves 21, 21 are fixedly fitted into a portion of the cylinder head 13 corresponding to each of the cylinders 12 for guiding intake valves 20, 20 as a pair of engine valves capable of opening and closing the intake valve bores 16, 16 respectively, and a pair of guide sleeves 23, 23 are also fixedly fitted into such portion for guiding exhaust valves 22, 22 capable of opening and closing the exhaust valve bores 17, 17 respectively. Valve springs 26, 26 and 27, 27 are provided under compression between the cylinder head 13 and collars 24, 24 and 25, 25 provided at upper ends of the intake and exhaust valves 20, 20 and 22, 22 projecting upwardly from the guide sleeves 21, 21 and 23, 23, respectively, so that the intake and exhaust valves 20, 20 and 22, 22 are biased upwardly, i.e., in respective closing directions by spring forces of the valve springs 26, 26 and 27, 27 respectively.

An intake-side valve operating device 28 is connected to the intake valves 20, 20 to open and close the intake valves 20, 20 in three-stage operating characteristics corresponding to the operating conditions of the engine. An exhaust-side valve operating device 29 is connected to the exhaust valves 22, 22 to open and close the exhaust valves 22, 22 in two-stage operating characteristics corresponding to the operating conditions of the engine.

Figure 2:
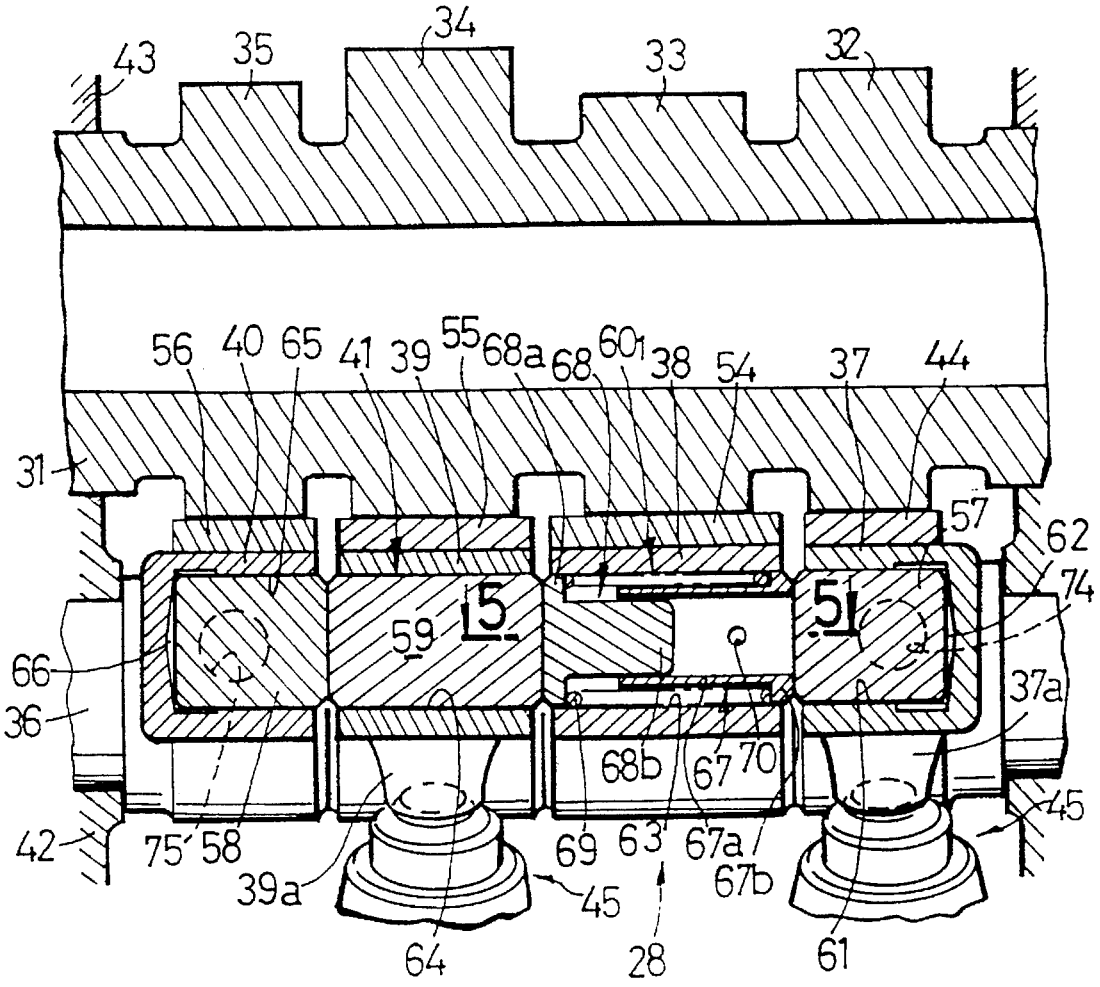
FIG. 2 is an enlarged sectional view taken along a line 2—2 in FIG. 1.
Figure 3:
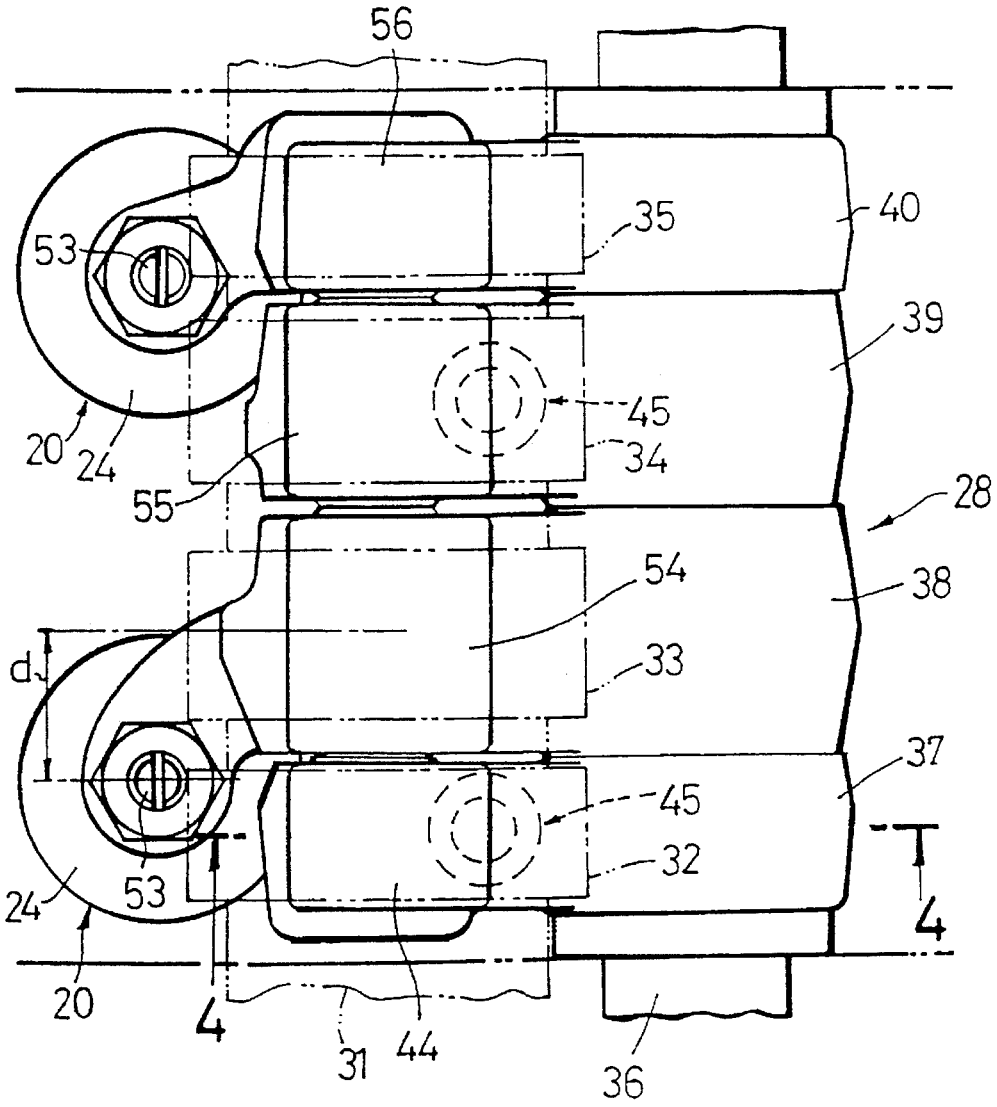
FIG. 3 is an enlarged view taken along a line 3—3 in FIG. 3.

Referring also to FIGS. 2 and 3, the intake-side valve operating device 28 comprises a cam shaft 31 rotatively driven at a reduction ratio of ½ from a crank shaft (not shown) of the engine, first, second, third and fourth cams 32, 33, 34 and 35 provided in an axial arrangement on the can shaft 31, a rocker shaft 36 fixedly disposed in parallel to the cam shaft 31, a first free rocker arm 37, a first driving rocker arm 38, a second free rocker arm 39 and a second driving rocker arm 40 which are swingably carried on the rocker shaft 36, and a connection switching means 41 provided on the rocker arms 37 to 40.

The cam shaft 31 is carried for rotation about an axis between a lower holder 42 integrally provided in the cylinder head 13 and an upper holder 43 fastened to the lower holder 42.

Figure 4:
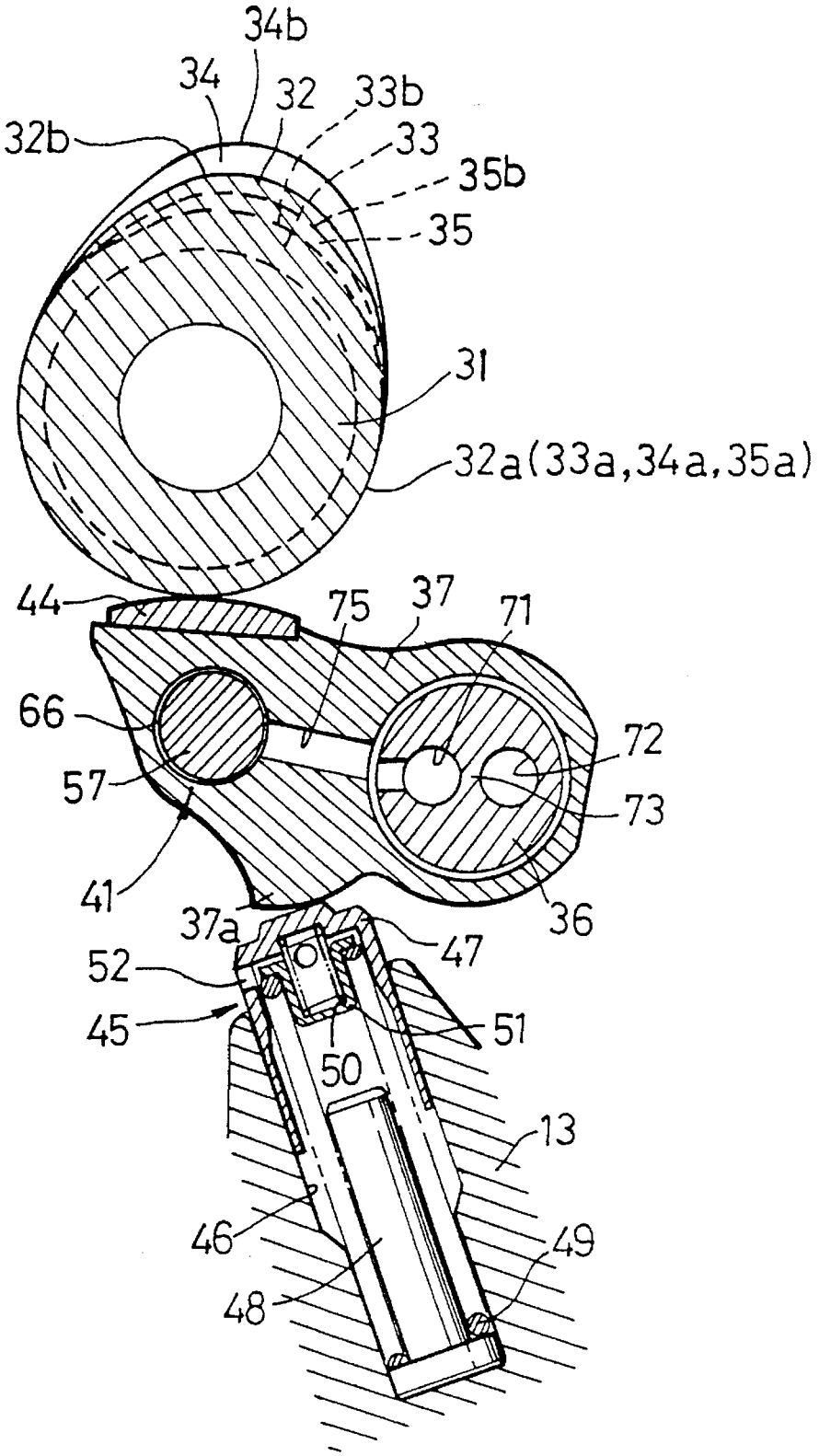
FIG. 4 is a sectional view taken along a line 4—4 in FIG. 3.

Referring also to FIG. 4, the first cam 32 has a profile corresponding to the medium-speed operating range of the engine and includes a base circle portion 32*a* formed around an outer periphery thereof and a cam lobe 32*b* which is also formed around the outer periphery to project radially outwardly from the base circle portion 32*a*. The second cam 33 has a profile corresponding to the low-speed operating range of the engine and includes a base circle portion 33*a* formed around an outer periphery thereof and having the same radius as the base circle portion 32*a* of the first cam 32, and a cam lobe 33*b* which is also formed around the outer periphery to project radially outwardly from the base circle portion 32*a* in a projecting amount smaller than that of the cam lobe 32*b* of the first cam 32. The third cam 34 has a profile corresponding to the high-speed operating range of the engine and includes a base circle portion 34*a* formed around an outer periphery thereof and having the same radius as the base circle portions 32*a* and 33*a*, and a cam lobe 34*b* which is also formed around the outer periphery to project from the base circle portion 34*a* in a projecting amount larger than that of the cam lobe 32*b* of the first cam 32. The fourth cam 35 has a profile corresponding to the low-and medium-speed operating ranges of the engine and includes a base circle portion 35*a* formed around an outer periphery thereof and having the same radius as the base circle portions 32*a*, 33*a* and 34*a*, and a cam lobe 35*b* which is also formed around the outer periphery to project from the base circle portion 32*a* in an intermediate projecting amount between those of the cam lobes 32*b* and 33*b* of the first and second cams 32 and 33.

The rocker shaft 36 is fixedly retained in the lower holder 42 of the cylinder head 13 at a location below the cam shaft 31 and has an axis parallel to the cam shaft 31. The following four rocker arms are commonly carried on the rocker shaft 36 for relative swinging movements: a first free rocker arm 37 provided to be in sliding contact with the first cam 32, a first driving rocker arm 38 operatively connected to one of the engine valves 20 and disposed adjacent one side of the first free rocker arm 37 to be in sliding contact with the second cam 33, a second free rocker arm 39 disposed adjacent one side of the first driving rocker arm 38 to be in sliding contact with the third cam 34, and a second driving rocker arm 40 operatively connected to the other engine valve 20 and disposed adjacent one side of the second free rocker arm 39 to be in sliding contact with the fourth cam 35.

The first free rocker arm 37 is swingably carried on the rocker shaft 36 to extend slightly below the cam shaft 31, and a cam slipper 44 is fixedly mounted on an upper portion of the first free rocker arm 37 adjacent its tip and to be in sliding contact with the first cam 32.

The first free rocker arm 37 is resiliently biased in a direction to maintain the cam slipper 44 in sliding contact with the first cam 32, by a lost motion mechanism 45 which is disposed in the cylinder head 13 substantially below the cam shaft 31. The lost motion mechanism 45 is comprised of a fitting hole 46 provided in the cylinder head 13 with its open end directed toward the first free rocker arm 37, a bottomed cylindrical lifter 47 slidably fitted in the fitting hole 46, and first and second springs 49 and 50 interposed in series between a guide member 48 received in a closed end of the fitting hole 46 and the lifter 47. The first spring 49 has a spring constant set larger than that of the second spring 50. The first spring 49 is provided under compression between a retainer 51 accommodated in the lifter 47 and the guide member 48, and the second spring 50 is provided under compression between the retainer 51 and the lifter 47. An opening hole 52 is provided in the lifter 47. Thus, the tip end of the lifter 47 projecting from the fitting hole 46 is resiliently brought into sliding contact with a pressure receiving portion 37*a* provided at a lower portion of the first free rocker arm 37 adjacent its tip end, so that the first free rocker arm 37 is normally maintained in sliding contact with the first cam 32 by the resilient force of the lost motion mechanism 45.

In such lost motion mechanism 45, in a condition in which the first free rocker arm 37 is in sliding contact with the base circle portion 32*a* of the first cam 32, the first spring 49 is in an uncompressed state with its normal free length and hence, it is possible to support and swing the first free rocker arm 37 while compressing only the second spring 50 having a relatively small spring constant for minimizing the friction forces between the cam base circle portion 32*a* and the can cam slipper 44 on rocker arm 37. This also is effective to align the fitting axes of the rocker arms 37 and 38 with each other, as the connection switching mechanism 41 is operated to connect the first free rocker arm 37 and the first driving rocker arm 38 to each other. When the free rocker arm 37 is brought into sliding contact with the cam lobe 32*b* of the first cam 32, it is biased toward the first cam 32 by a relatively large spring force by compression of the first spring 49 having the relatively large spring constant. As a result, a reliable sliding contact of the free rocker arm 37 with the first cam 32 is achieved.

The first driving rocker arm 38 is swingably carried on the rocker shaft 36 to extend toward one of the intake valves 20. A tappet screw 53 is threadedly fitted into a tip end of the first driving rocker arm 38 to abut against the upper end of the intake valve 20, so that its advanced or retreated position can be adjusted. Moreover, as best shown in FIG. 3, the threadedly fitted position of the tappet screw 53 into the first driving rocker arm 38, i.e., the position of operative connection of the intake valve 20 to the first driving rocker arm 38 is offset toward the first free rocker arm 37 by an offset amount "d" from the center of the first driving rocker arm 38 along the axis of the rocker shaft 36, whereby the position of the operative connection between the first driving rocker arm 38 and the intake valve 20 is established in the vicinity of the position of connection between the first free rocker arm 37 and the first driving rocker arm 38.

In the first driving rocker arm 38, a cam slipper 54 is fixedly mounted on an upper surface of an intermediate portion between the position of the operative connection of the first driving rocker arm 38 to the intake valve 20 and the rocker shaft 36 to come into sliding contact with the second cam 33.

The second free rocker arm 39 is swingably carried on the rocker shaft 36 to extend slightly below the cam shaft 31, and a cam slipper 55 is fixedly mounted on an upper portion of the second free rocker arm 39 adjacent its tip end to come into sliding contact with the third cam 34. Moreover, the second free rocker arm 39 is resiliently biased in a direction to bring the cam slipper 55 into sliding contact with the third cam 34, by a lost motion mechanism 45 provided in the cylinder head 13 in a construction similar to that of the above-described lost motion mechanism 45. The second free rocker arm 39 is provided at its lower portion with a pressure receiving portion 39*a* for engaging the lost motion mechanism 45 in sliding contact.

The second driving rocker arm 40 is swingably carried on the rocker shaft 36 to extend toward the other intake valve 20, and a tappet screw 53 abutting against the upper end of the intake valve 20 is threadedly fitted into a tip end of the second driving rocker arm 40, so that its advanced or retreated position can be adjusted. In the second driving rocker arm 40, a cam slipper 56 is fixedly mounted on an upper surface of an intermediate portion between the rocker shaft 36 and the position of operative connection of the second driving rocker arm 40 to the intake valve 20 to come into sliding contact with the fourth cam 35.

Particularly referring to FIG. 2, the connection switching means 41 comprises a medium-speed switching pin 57 for interconnecting the first free rocker arm 37 and the first driving rocker arm 38 in the medium-speed operating range of the engine, a first high-speed switching pin 58 for interconnecting the second driving rocker arm 40 and the second free rocker arm 39 in the high-speed operating range of the engine, a second high-speed switching pin 59 for interconnecting the second free rocker arm 39 and the first driving rocker arm 38 in operative association with the first high-speed switching pin 58 in the high-speed operating range of the engine, and a resilient mechanism $\mathbf{60}_1$ for exhibiting a resilient force for biasing the medium-speed switching pin 57 as well as the first and second high-speed switching pins 58 and 59 toward their connection releasing positions.

A first bottomed guide hole 61 opened toward the first driving rocker arm 38 is provided in the first free rocker arm 37 parallel to the rocker shaft 36, and the columnarly-formed medium-speed switching pin 57 is slidably fitted into the first guide hole 61. A first hydraulic pressure chamber 62 is defined between one end of the medium-speed switching pin 57 and a closed end of the first guide hole 61.

A first through guide hole 63 is provided in the first driving rocker arm 38 at a location corresponding to the first guide hole 61 and parallel with the rocker shaft 36 to extend between opposite sides, so that the other end of the medium-speed switching pin 57 can be fitted into the first through guide hole 63. A second through guide hole 64 is provided in the second free rocker arm 39 at a location corresponding to the first through guide hole 63 and parallel with the rocker shaft 36 to extend between opposite sides. A second bottomed guide hole 65 opened toward the second free rocker arm 39 is provided in the second driving rocker arm 40 at a location corresponding to the second through guide hole 64 and parallel to the rocker shaft 36.

The columnarly-formed second high-speed switching pin 59, whose one end can be fitted into the first through guide hole 63, is slidably fitted into the second through guide hole 64 in the second free rocker arm 39, and the columnarly-formed first high-speed switching pin 58, whose one end can be fitted into the second through guide hole 64, is slidably fitted into the second bottomed guide hole 65 in the second driving rocker arm 40. One end of the first high-speed switching pin 58 is in sliding contact with the other end of the second high-speed switching pin 59, and a second hydraulic pressure chamber 66 is defined between the other end of the first high-speed switching pin 58 and a closed end of the second bottomed guide hole 65. Thus, when the first high-speed switching pin 58 is operated in a direction for fitting into the second through guide hole 64 in response to a hydraulic pressure applied to the second hydraulic pressure chamber 66, the second high-speed switching pin 59 is operated in a direction for fitting into the first through guide hole 63 in operative association with the first high-speed switching pin 58.

Figure 5:
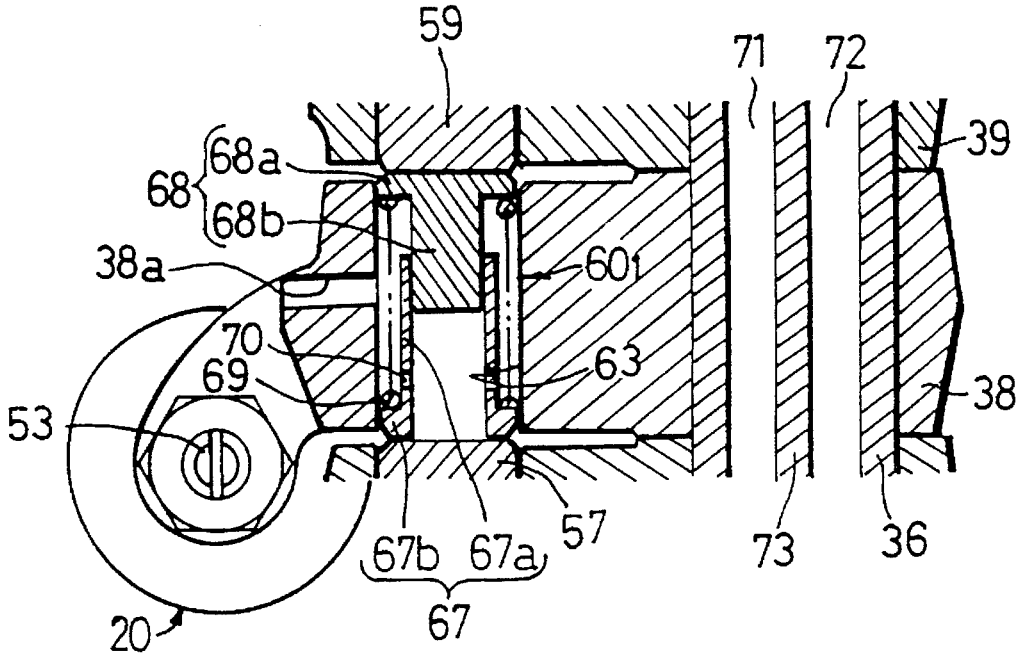
FIG. 5 is a sectional view taken along a line 5—5 in FIG. 4.

Referring also to FIG. 5, the resilient mechanism $\mathbf{60}_1$ comprises a first retainer 67 slidably fitted in the first through guide hole 63 adjacent the first free rocker arm 37, a second retainer 68 slidably fitted in the first through guide hole 63 adjacent the second free rocker arm 39 and slidably fitted in the first retainer 67 for relative sliding movement in a given range, and a return spring 69 provided under compression between both the retainers 67 and 68.

The first retainer 67 is comprised of a cylindrical portion 67*a* coaxially inserted into the first through guide hole 63, and a collar portion 67*b* integrally provided at one end of the cylindrical portion 67*a* to protrude radially outwardly, with its outer peripheral surface being in sliding contact with an inner surface of the first through guide hole 63 and with the other end of the medium-speed switching pin 57. The second retainer 68 is comprised of a disk-like portion 68*a* provided to come into sliding contact with one end of the second high-speed switching pin 59 with its outer peripheral surface being in sliding contact with an inner surface of the first through guide hole 63, and a shaft portion 68*b* integrally connected to the disk-like portion 68*a* and slidably fitted in the cylindrical portion 67*a* of the first retainer 67. The return spring 69 is a coiled compression spring surrounding the cylindrical portion 67*a* of the first retainer 67 as well as the shaft portion 68*b* of the second retainer 68, and is mounted under compression between the collar portion 67*b* of the first retainer 67 and the disk-like portion 68*a* of the second retainer 68.

An air vent hole 70 is provided in one end of the cylindrical portion 67*a* of the first retainer 67, and an opening hole 38*a* is provided in the first driving rocker arm 38 for opening the inside of the first guide hole 63 to the outside. This avoids the pressurization and depressurization of the inside of the cylindrical portion 67*a* which may be produced with relative sliding movement of the first and second retainers 67 and 68, thereby allowing a smooth relative sliding movement of the first and second retainers 67 and 68.

With such resilient mechanism $\mathbf{60}_1$, the medium-speed switching pin 57 is resiliently biased in a direction to reduce the volume of the first hydraulic pressure chamber 62, and the first and second high-speed switching pins 58 and 59 operatively associated with each other are resiliently biased in a direction to reduce the volume of the second hydraulic pressure chamber 66, by the spring force of the return spring 69. When the first hydraulic pressure chamber 62 is in a hydraulic pressure-released state, the sliding contact surfaces of the medium-speed switching pin 57 and the first retainer 67 are located at a position corresponding to a plane between the first free rocker arm 37 and the first driving rocker arm 38, so that the first free rocker arm 37 and the first driving rocker arm 38 are not in a connected relation to each other and are in their relatively swingable states. When the second hydraulic pressure chamber 66 is in a hydraulic pressure-released state, the sliding contact surfaces of the second high-speed switching pin 59 and the second retainer 68 are located at a position corresponding to a plane between the first driving rocker arm 38 and the second free rocker arm 39, and the sliding contact surfaces of the first and second high-speed switching pins 58 and 59 are located at a position corresponding to a plane between the second free rocker arm 39 and the second driving rocker arm 40, so that the first driving rocker arm 38 and the second free rocker arm 39, as well as the second free rocker arm 39 and the second driving rocker arm 40 are not in their interconnected states, and the first driving rocker arm 38, the second free rocker arm 39 and the second driving rocker arm 40 are in their relatively swingable states.

In addition, when the second hydraulic pressure chamber 66 is in the hydraulic pressure-released state, i.e., when the first and second high-speed switching pins 58 and 59 are in their disconnecting positions, the application of a hydraulic pressure to the first hydraulic pressure chamber 62 causes the medium-speed switching pin 57 to be moved in a direction to increase the volume of the first hydraulic pressure chamber 62 and to be thereby partially fitted into the first through guide hole 63 when the first free rocker arm 37 and the first driving rocker arm 38 are in sliding contact with the base circle portions 32*a* and 33*a* of the first and second cams 32 and 33, respectively. As a result, the first free rocker arm 37 and the first driving rocker arm 38 are connected to each other by the medium-speed switching pin 57. During this time, the medium-speed switching pin 57 is slidably fitted into the first through guide hole 63, until the movement thereof is limited by abutment of the cylindrical portion 67*a* of the first retainer 67 against the disk-like portion 68*a* of the second retainer 68. Further, when the first hydraulic pressure chamber 62 is in the hydraulic pressure-released state, i.e., when the medium-speed switching pin 57 is in its disconnecting position, the application of a hydraulic pressure to the second hydraulic pressure chamber 66 causes the first high-speed switching pin 58 to be moved in a direction to increase the volume of the second hydraulic pressure chamber 66 and to be thereby partially fitted into the second through guide hole 64 when the first driving rocker arm 38, the second free rocker arm 39 and the second driving rocker arm 40 are in sliding contact with the base circle portions 33*a*, 34*a* and 35*a* of the second, third and fourth cams 33, 34 and 35, respectively. A portion of the second high-speed switching pin 59 is pushed by the first high-speed switching pin 58 and thereby is partially fitted into the first through guide hole 63. As a result, the first driving rocker arm 38, the second free rocker arm 39 and the second driving rocker arm 40 are connected to one another by the first and second high-speed switching pins 58 and 59. In this case, the movement of the first and second high-speed switching pins 58 and 59 is limited by the abutment of the disk-like portion 68*a* of the second retainer 68 against the cylindrical portion 67*a* of the first retainer 67.

A first oil passage 71 and a second oil passage 72 are provided in the rocker shaft 36 parallel to the axis of the rocker shaft 36 and partitioned from each other by a partition wall 73. A communication passage 74 is provided in the first free rocker arm 37 for permitting the first oil passage 71 to be normally in communication with the first hydraulic pressure chamber 62 irrespective of the swinging of the first free rocker arm 37. A communication passage 75 is provided in the second driving rocker arm 40 for permitting the second oil passage 72 to be normally in communication with the second hydraulic pressure chamber 66 irrespective of the swinging of the second driving rocker arm 40.

In the low-speed operating range of the engine, the hydraulic pressures in both the first and second oil passages 71 and 72, i.e., in the first and second hydraulic pressure chambers 62 and 66 have been released. In the medium-speed operating range of the engine, the hydraulic pressures in the second oil passage 72 and the second hydraulic pressure chamber 66 remain released, but a hydraulic pressure is applied to the first oil passage 71 and the first hydraulic pressure chamber 62. In the high-speed operating range of the engine, a hydraulic pressure is applied to the second oil passage 72 and the second hydraulic pressure chamber 66 in a condition in which the hydraulic pressures in the first oil passage 71 and the first hydraulic pressure chamber 62 have been released.

Figure 6:
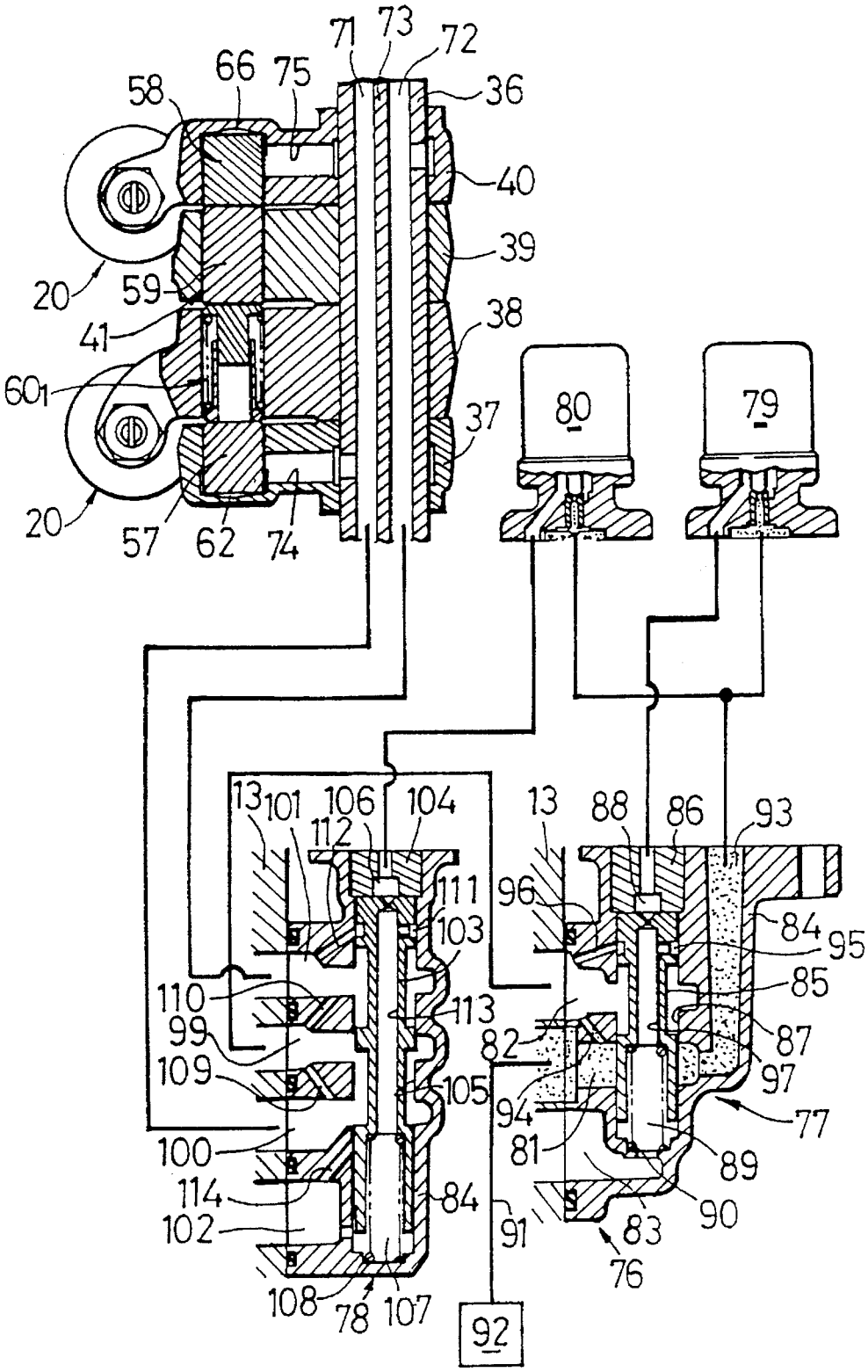
FIG. 6 is a sectional view illustrating an operation switching control means in an operative state in a low-speed operating range.

Referring to FIG. 6, an operation switching control means 76 for controlling the application and release of the hydraulic pressure to and from the first and second hydraulic pressure chambers 62 and 66, depending upon the operating region of the engine, as described above, comprises first and second switch-over valves 77 and 78, and first and second solenoid on-off valves 79 and 80.

The first switch-over valve 77 is comprised of a valve spool 85 slidably received in a housing 84 which is mounted to one end face of the cylinder head 13 and has an inlet port 81, an outlet port 82 and a release port 83.

The housing 84 is provided with a cylinder bore 87 with its upper end closed by a cap 86, and the valve spool 85 is slidably received in the cylinder bore 87 to define a pilot hydraulic pressure chamber 88 between the valve spool 85 itself and the cap 86. Moreover, a spring chamber 89 is defined between a lower portion of the housing 84 and the valve spool 85 to lead to the release port 83, and a spring 90 is accommodated in the spring chamber 89 for biasing the valve spool 85 upwardly. Thus, the valve spool 85 is biased by the spring 90 into an upper position to block the communication between the inlet port 81 and the outlet port 82 from each other. When a high hydraulic pressure is applied to the pilot hydraulic pressure chamber 88, the valve spool 85 is moved by a hydraulic pressure force in the pilot hydraulic pressure chamber 88 into a lower position to permit the inlet port 81 to be put into communication with the outlet port 82.

The inlet port 81 communicates with an oil passage 91 provided in the cylinder head 13 and connected to a hydraulic pressure source 92. The housing 84 is provided with a pilot oil passage 93 leading to the inlet port 81, and the first solenoid on-off valve 79 mounted to the housing 84 is interposed between the pilot oil passage 93 and the pilot hydraulic pressure chamber 88.

The housing 84 is provided with an orifice 94 which permits the inlet port 81 and the outlet port 82 to be put into communication with each other. Even when the valve spool 85 is in the upper position in which it blocks the direct and full communication between the inlet port 81 and the outlet port 82 from each other, the inlet port 81 and the outlet port 82 are in communication with each other through the orifice 94. Further, the housing 84 is provided with an orifice 96 which permits an annular groove 95 provided in an outer surface of the valve spool 85 to be put into communication with the outlet port 82, when the valve spool 85 is in the upper position.

The second switch-over valve 78 is provided in the same housing 84 as the first switch-over valve 77 and is comprised of a valve spool 103 slidably received in the housing 84 having an input port 99, a first outlet port 100, a second outlet port 101 and a release port 102.

The housing 84 also has a cylinder bore 105 provided therein parallel to the cylinder bore 87 in the first switch-over valve 77 and closed at its upper end by a cap 104. The valve spool 103 is slidably received in the cylinder bore 105 to define a pilot hydraulic pressure chamber 106 between the valve spool 103 itself and the cap 104. Moreover, a spring chamber 107 is defined between a lower portion of the housing 84 and the valve spool 103 to lead to the release part 102, and a spring 108 is accommodated in the spring chamber 107 for biasing the valve spool 103 upwardly. Thus, the valve spool 103 is biased by the spring 108 into an upper position to place the inlet port 99 in communication with the first outlet port 100 and out of communication with the second outlet port 101. When a high hydraulic pressure is applied to the pilot hydraulic pressure chamber 106, the valve spool 103 is moved by a hydraulic pressure force in the pilot hydraulic pressure chamber 106 into a lower position to place the inlet port 99 in communication with the second outlet port 101 and out of communication with the first outlet port 100.

The inlet port 99 is connected to the outlet port 82 in the first switch-over valve 77. The first outlet port 100 is connected to the first oil passage 71 in the rocker shaft 36, and the second outlet port 101 is connected to the second oil passage 72 in the rocker shaft 36. The second solenoid on-off valve 80 mounted to the housing 84 is interposed between the pilot oil passage 93 provided in the housing 84 and the pilot hydraulic pressure chamber 106.

The housing 84 is also provided with orifices 109 and 110 for placing the inlet port 99 in communication with the first and second outlet ports 100 and 101, respectively. The housing 84 is further provided with an orifice 112 which permits an annular groove 111 provided in an outer surface of the valve spool 103 to be in communication with the second outlet port 101, when the valve spool 103 is in the upper position in which it blocks the communication between the inlet port 99 and the second outlet port 101 and permits the inlet port 99 to be in communication with the first outlet port 100. The valve spool 103 is provided with a passage 113 which permits the annular groove 111 to be in communication with the release port 102. Further, the housing 84 is provided with an orifice 114 which permits the first outlet port 100 to be in communication with the release port 102, when the valve spool 103 is in the lower position in which it blocks the communication between the inlet port 99 and the first outlet port 100 and permits the inlet port 99 to be put in communication with the second outlet port 101.

In such operation switching control means 76, the opening and closing of the first and second solenoid on-off valves 79 and 80 are controlled depending upon the operating range of the engine. More specifically, in the low-speed operating range of the engine, both of the first and second solenoid on-off valves 79 and 80 are closed. Thus, no hydraulic pressure is applied to the pilot hydraulic pressure chambers 88 and 106 in the first and second switch-over valves 77 and 78 and, as shown in FIG. 6, both of the valve spools 85 and 103 are in their upper positions. As a result, no hydraulic pressure is produced in the outlet port 82 of the first switch-over valve 77, and the first and second oil passages 71 and 72 in the rocker shaft 36 are in their hydraulic pressure- released states. Therefore, the first and second hydraulic pressure chambers 62 and 66 in the connection switching means 41 are also in their hydraulic pressure-released states, and the rocker arms 37 to 40 are in their separately swingable states.

Figure 7:
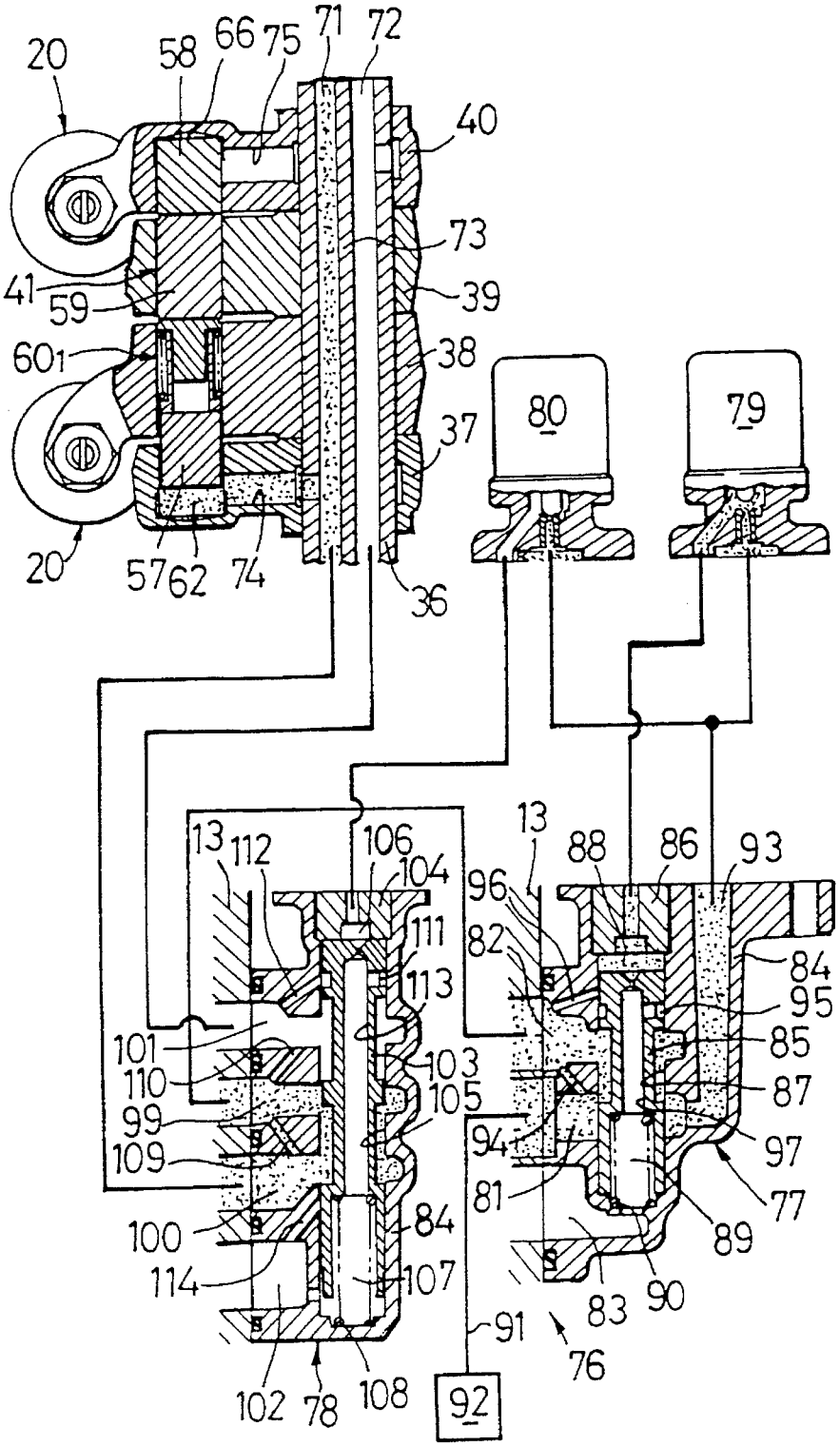
FIG. 7 is a sectional view illustrating the operation switching control means in an operative state in a medium-speed operating range.

In the medium-speed operating range of the engine, as shown in FIG. 7, the first solenoid on-off valve 79 is opened, and the second solenoid on-off valve 80 remains closed. This causes the valve spool 85 in the first switch-over valve 77 to be moved to the lower position, so that the inlet port 81 is put into communication with the outlet port 82. On the other hand, in the second switch-over valve 78, the valve spool 103 is in its upper position, and the inlet port 99 is in communication with the first outlet port 100. Therefore, a hydraulic pressure is applied to the first hydraulic pressure chamber 62 through the first oil passage 71, as shown by stippling in FIG. 7, while the second hydraulic pressure chamber 66 is in its hydraulic pressure-released state. Thus, in the connection switching means 41, the medium-speed switching pin 57 is fitted into the first driving rocker arm 38 while compressing the resilient mechanism $60_1$, thereby interconnecting the first free rocker arm 37 and the first driving rocker arm 38. On the other hand, by the fact that the second hydraulic pressure chamber 66 is in the hydraulic pressure-released state, the first and second high-speed switching pins 58 and 59 remain at the disconnecting positions, so that the second driving rocker arm 40 and the second free rocker arm 39 are swingable relative each other and also relative to the first driving rocker arm 38.

Figure 8:
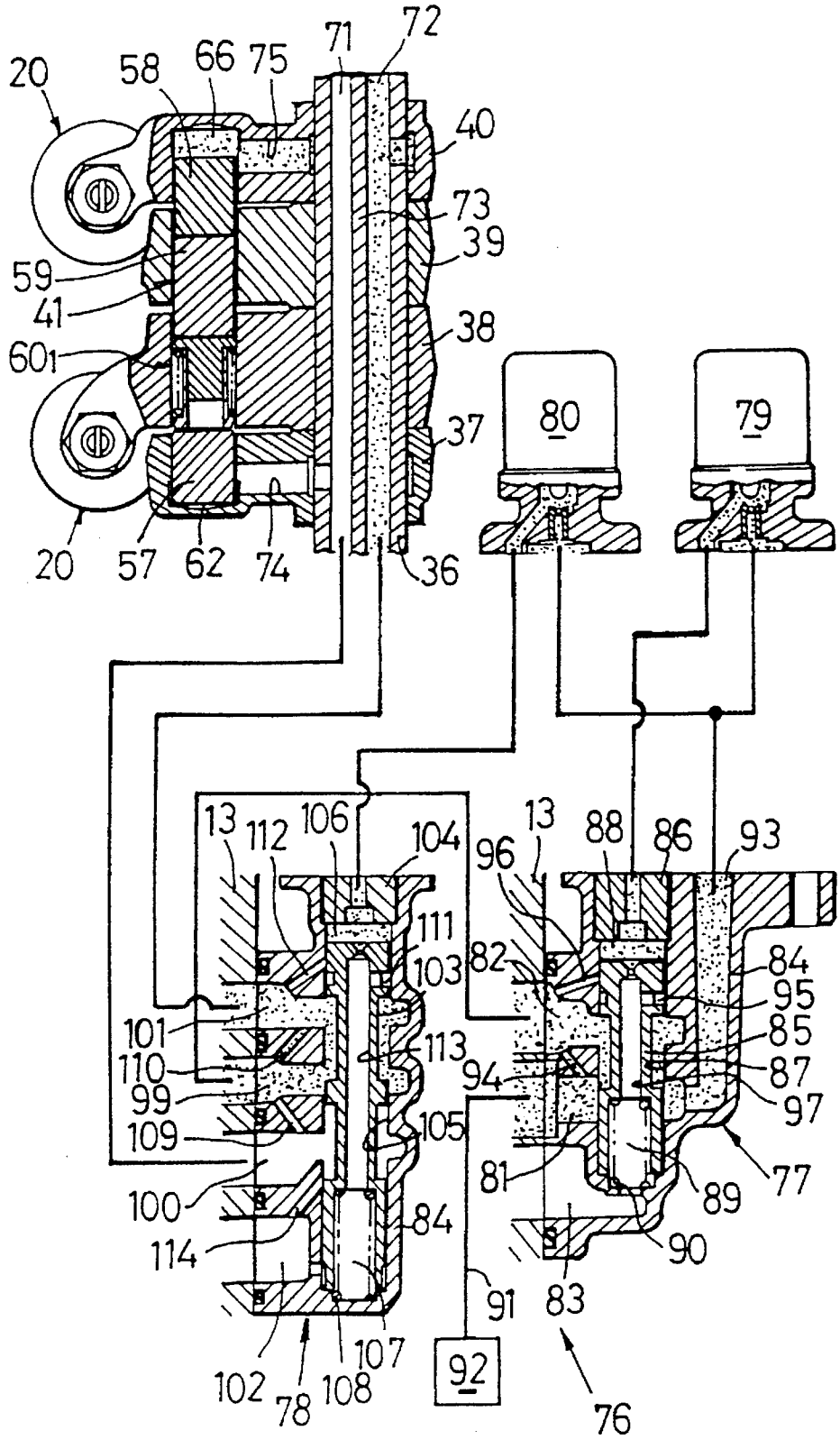
FIG. 8 is a sectional view illustrating the operation switching control means in an operative state in a high-speed operating range.

Further, in the high-speed operating range of the engine, both of the first and second solenoid on-off valves 79 and 80 are opened, as shown in FIG. 8. This causes the valve spool 103 in the second switch-over valve 78 to be moved to the lower position, so that the input port 99 is placed in communication with the second outlet port 101 and out of communication with the first outlet port 100. Thus, a hydraulic pressure is applied to the second hydraulic pressure chamber 66 through the second oil passage 72, while the hydraulic pressure in the first oil passage 71 leading to the first hydraulic pressure chamber 62 is released by the communication of the first outlet port 100 with the release port 102 through the orifice 114. Therefore, in the connection switching means 41, the first and second high-speed switching pins 58 and 59 are moved into the connecting positions in operative association with each other, while compressing the resilient mechanism $60_1$, so that the first high-speed switching pin 58 is fitted into the second free rocker arm 39, and the second high-speed switching pin 59 is fitted into the first driving rocker arm 38. The medium-speed switching pin 57 is moved into its disconnecting position by the spring force of the resilient mechanism $60_1$. As a result, the first driving rocker arm 38, the second free rocker arm 39 and the second driving rocker arm 40 are connected together, and only the free rocker arm 37 is brought into a disconnected relation to these rocker arms 38, 39 and 40.

In this manner, the connection and disconnection of a combination of the rocker arms 37 to 40 can be changed depending upon the operating range of the engine. The application and release of the hydraulic pressure to and from the first and second hydraulic chambers 62 and 66 in the connection switching means are controlled by a switching operation of the first switch-over valve 77 depending upon the opening and closing of the first solenoid valve 79 in the changing of the low- and medium-speed operating ranges of the engine from one to another, and by a switching operation of the second switch-over valve 78 depending upon the opening and closing of the second solenoid valve 80 in the changing of the medium- and high-speed operating ranges of the engine from one to another. Therefore, the construction is simple, as compared with the construction in which the switch-over valves are independently connected to the first and second oil passages 71 and 72, and moreover, it is possible to prevent a hunting from occurring during switching.

Figure 9:
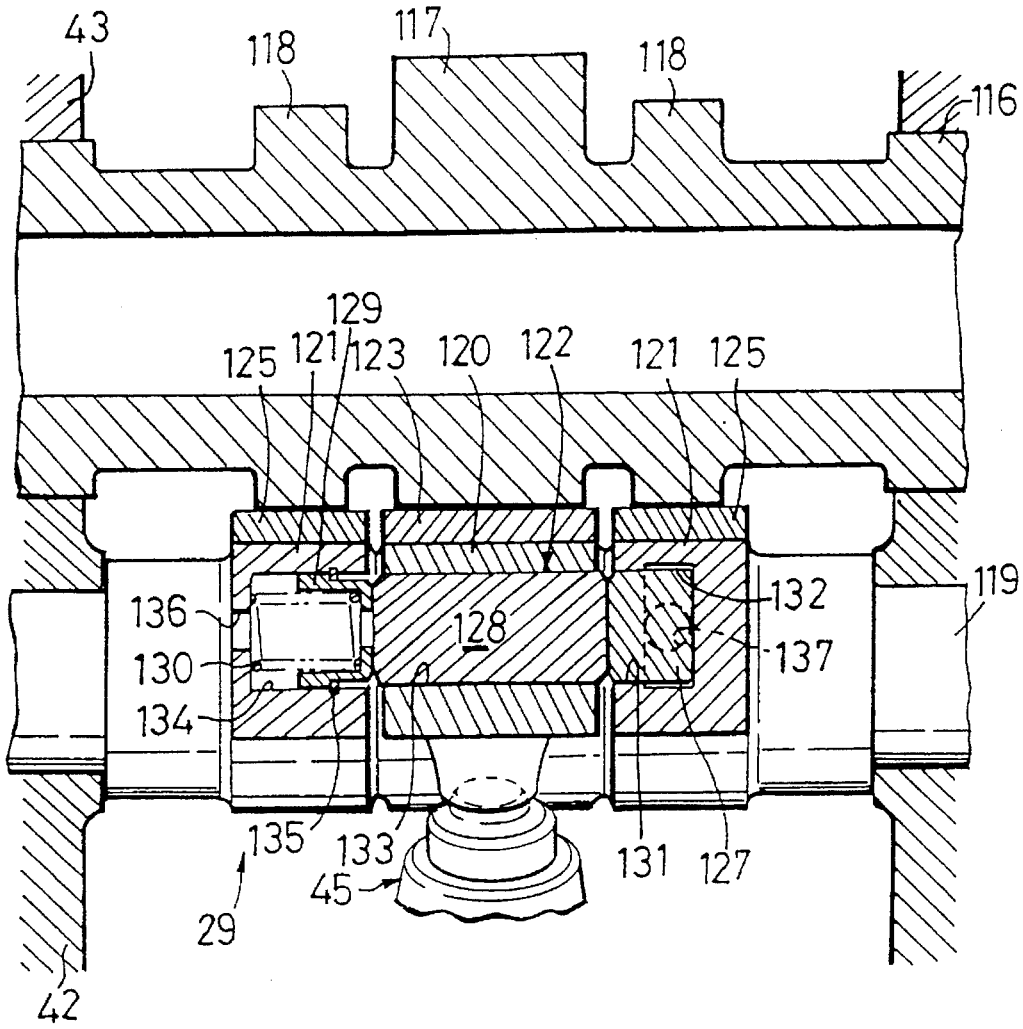
FIG. 9 is an enlarged sectional view taken along a line 9—9 in FIG. 1.
Figure 10A:
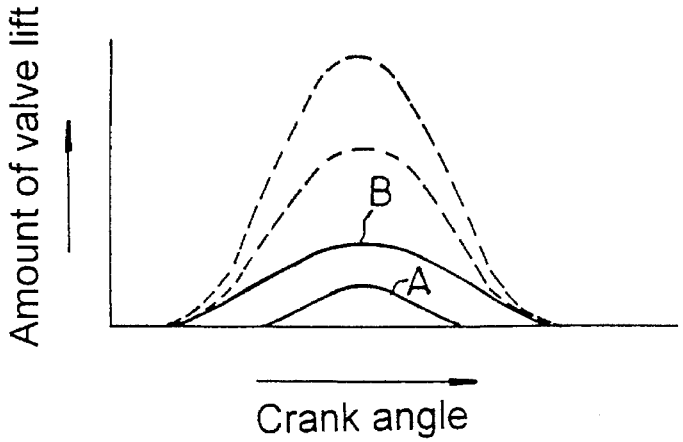
FIGS. 10A, 10B and 10C are diagrams illustrating operating characteristics of an intake valve in the low-speed, medium-speed and high-speed operating ranges, respectively.
Figure 10B:
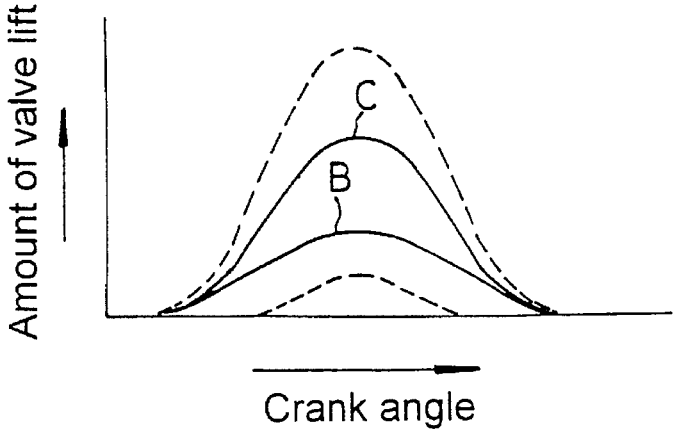
Figure 10C:
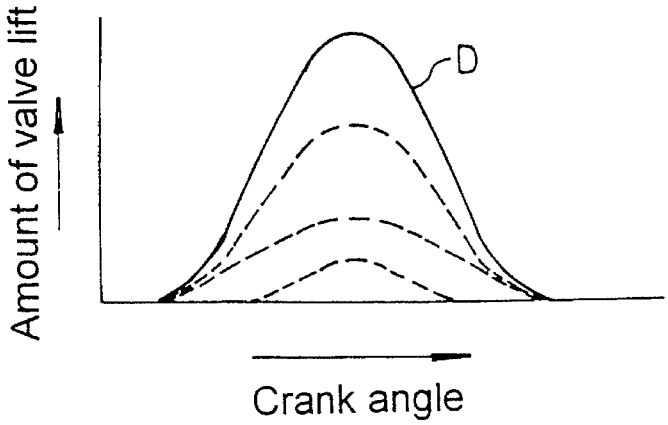

Referring now to FIGS. 1 and 9, the exhaust-side valve operating device 29 comprises a cam shaft 116 rotatively driven at a reduction ratio of ½ from the crank shaft (not shown) of the engine, a single high-speed cam 117 and a pair of low/medium-speed cams 118, 118 which are provided on the cam shaft 116, a rocker shaft 119 fixedly disposed parallel to the cam shaft 116, a single free rocker arm 120 and a pair of driving rocker arms 121, 121 which are swingably carried on the rocker shaft 119, and a connection switching means 122 provided on the rocker arms 120, 121, 121.

The cam shaft 116 is rotatably carried between the lower holder 42 and the upper holder 43 for rotation about an axis, and the pair of low- and medium-speed cams 118, 118 are disposed on opposite sides of the high-speed cam 117. The rocker shaft 119 is fixedly retained by the lower holder 42 at a location below the cam shaft 116 and has an axis parallel to the cam shaft 116. Three rocker arms are swingably carried on the rocker shaft 119 adjacent one another, namely, a pair of driving rocker arms 121, 121 independently operatively connected to a pair of exhaust valves 22, 22 respectively, and a single free rocker arm 120 sandwiched between the driving rocker arms 121, 121.

The free rocker arm 120 is swingably carried on the rocker shaft 119 to slightly extend below the cam shaft 116, and a cam slipper 123 is fixedly mounted on an upper portion of the free rocker arm 120 adjacent its tip end to come into sliding contact with the high-speed cam 117. The free rocker arm 120 is resiliently biased in a direction to bring the cam slipper 123 into sliding contact with the high-speed cam 117 by a lost motion mechanism 45, similar to previously described lost motion mechanism 45, disposed in the cylinder head 13 substantially below the cam shaft 116.

The driving rocker arms 121, 121 are swingably carried on the rocker shaft 119 to extend toward the exhaust valves 22, 22. A tappet screw 124 is threadedly fitted into a tip end of each of the driving rocker arms 121, 121 to abut against an upper end of the exhaust valve 22, so that its advanced or retreated position can be adjusted. Therefore, the exhaust valves 22 are opened and closed in response to the swinging movement of the driving rocker arms 121, 121.

In the driving rocker arms 121, 121, cam slippers 125, 125 are fixedly mounted on upper surfaces of intermediate portions between the positions of operative connection of the driving rocker arms 121 to the exhaust valves 22 and the rocker shaft 119 to come into sliding contact with the low/medium-speed cams 118, 118, respectively.

The connection switching means 122 comprises a first switching pin 127 capable of interconnecting one of the driving rocker arms 121 and the free rocker arm 120, a second switching pin 128 capable of interconnecting the free rocker arm 120 and the other driving rocker arm 121 and having one end abutting against the first switching pin 127, a limiting member 129 which abuts against the other end of the second switching pin 128, and a return spring 130 for biasing the switching pins 127 and 128 and the limiting member 129 toward their disconnecting positions.

A first bottomed guide hole 131 is provided in the one driving rocker arm 121 in parallel to the rocker shaft 119 and opened toward the free rocker arm 120. The columnarly-formed first switching pin 127 is slidably fitted into the first guide hole 131, and a hydraulic pressure chamber 132 is defined between one end of the first switching pin 127 and a closed end of the first bottomed guide hole 131.

A through guide hole 133 corresponding to the first bottomed guide hole 131 is provided in the free rocker arm 120 parallel to the rocker shaft 119 to extend between opposite sides, and the second switching pin 128 with one end abutting against the other end of the first switching pin 127 is slidably fitted into the through guide hole 133.

A second bottomed guide hole 134 corresponding to the through guide hole 133 is provided in the other driving rocker arm 121 parallel to the rocker shaft 119 and opened toward the free rocker arm 120. The bottomed cylindrical limiting member 129 abutting against the other end of the second switching pin 128 is slidably fitted into the second bottomed guide hole 134, and the return spring 130 is provided under compression between the limiting member 129 and a closed end of the second guide hole 134. A retaining ring 135 is fitted to an inner surface of the second bottomed guide hole 134 to engage the limiting member 129 to inhibit a discharge of the limiting member 129 from the second bottomed guide hole 134, and an opening hole 136 is provided in the closed end of the second guide hole 134 to prevent air or oil pressure resistance to movement of the limiting member 129.

A communication passage 137 is provided in the one driving rocker arm 121 to lead to the hydraulic pressure chamber 132, and is normally in communication with an oil passage 138 which is coaxially provided in the rocker shaft 119.

In such connection switching means 122, the hydraulic pressure in the oil passage 138 is released in the low- and medium-speed operating ranges of the engine, and a hydraulic pressure is applied to the oil passage 138 in the high-speed operation region of the engine. More specifically, in the low- and medium-speed operating ranges of the engine, the connection switching means 122 is in a disconnecting state, and the rocker arms 120, 121, 121 are in their independently swingable states. Thus, the pair of exhaust valves 22, 22 are opened and closed by swinging movements of the driving rocker arms 121, 121 which are in sliding contact with the low/medium-speed cams 118, 118, respectively, wherein the opening and closing characteristics of the exhaust valves 22, 22 correspond to profiles of the low/medium-speed cams 118, 118, respectively. In the high-speed operating range of the engine, the application of a hydraulic pressure to the oil passage 138 causes the connection switching means 122 to be operated to connect the free rocker arm 120 to the driving rocker arms 121, 121 located on the opposite sides thereof. That is, all the rocker arms 120, 121, 121 are connected together, so that the driving rocker arms 121, 121 are along with the free rocker arm 120 swung by the high-speed cam 117, wherein the opening and closing characteristics of the exhaust valves 22, 22 correspond to a profile of the high-speed cam 117.

The operation of the first embodiment now will be described. When the engine is in the low-speed operating range, the rocker arms 37 to 40 in the intake-side valve operating device 28 are in their disconnected and relatively swingable states, so that one of the intake valves 20 operatively connected to the first driving rocker arm 38 is opened and closed by the second cam 33 having the profile corresponding to the low-speed operating range, and the other intake valve 20 operatively connected to the rocker arm 40 is opened and closed by the fourth cam 35 having the profile corresponding to the low- and medium-speed operating ranges. In this case, the opening and closing characteristic of the one intake valve 20 by low-speed cam 33 is as shown by a curve A in FIG. 10A, and the operating characteristic of the other intake valve 20 by cam 35 is as shown by a curve B in FIG. 10A. In the exhaust-side valve operating device, the rocker arms 120, 121 and 121 are in their disconnected and relatively swingable states, so that the pair of exhaust valves 22, 22 operatively connected to the driving rocker arms 121, 121 are opened and closed by the low/medium-speed cams 118, 118 having the profiles corresponding to the low- and medium-speed operating ranges. Therefore, in the low-speed operating range, the overlapping of opening time points for the intake valves 20, 20 and the exhaust valves 22, 22 can be reduced, and the blow-by and blow-back of the intake gas can be prevented to the utmost, thereby enhancing the substantial intake gas charging efficiency, providing a reduction in fuel consumption, and stabilizing the combustibility and enhancing the drivability during idling.

When the engine is in the medium-speed operating range, the first free rocker arm 37 and the first driving rocker arm 38 in the intake-side valve operating device 28 are interconnected, while the first driving rocker arm 38, the second free rocker arm 39 and the second driving rocker arm 40 are in their disconnected and relatively swingable states, so that one of the intake valves 20 operatively connected to the first driving rocker arm 38 is opened and closed by the first cam 32 having the profile corresponding to the medium-speed operating range, and the other intake valve 20 operatively connected to the second driving rocker arm 40 is opened and closed by the fourth cam 35 having the profile corresponding to the low- and medium-speed operating ranges. In this case, the operating characteristic of the one intake valve 20 operated by cam 32 is as shown by a curve C in FIG. 10B, and the operating characteristic of the other intake valve 20 is as shown by a curve B in FIG. 10B. In the exhaust-side valve operating device 29, the rocker arms 120, 121, 121 remain in their disconnected and relatively swingable states, wherein the exhaust valves 22, 22 are opened and closed by the low/medium-speed cams 118, 118. Therefore, it is possible to prevent a reduction of output torque and substantially reduce the fuel consumption.

Further, when the engine is in the high-speed operating range, the first and second driving rocker arms 38 and 40 in the intake-side valve operating device 28 are connected to the second free rocker arm 39, so that the intake valves 20, 20 are opened and closed by the third cam 34 having the profile corresponding to the high-speed operating range. In this case, the operating characteristic of both the intake valves 20, 20 is as shown by a curve D in FIG. 10C. In the exhaust-side valve operating device 29, the rocker arms 120, 121, 121 are connected together, so that the exhaust valves 22, 22 are opened and closed by the high-speed cam 117. Thus, it is possible to determine a closing time point for the intake valves 20, 20 at a predetermined crank angle after passage of the piston 14 through a lower dead center, so that a positive pressure of the intake gas and the internal pressure of the cylinder 12 are substantially equal to each other, and to enhance the intake gas charging efficiency and considerably increase the output by utilizing an inertia effect to the maximum.

In the intake-side valve operating device 28, in the high-speed operating range of the engine, the second free rocker arm 39 swung by the third cam 34 is in the state in which it has been connected to the first and second driving rocker arms 38 and 40 located on the opposite sides thereof. That is, only three rocker arms 38, 39 and 40 of the four rocker arms 37 to 40 are connected to open and close the intake valves 20, 20. Therefore, it is possible to relatively reduce the equivalent inertial mass in the high-speed operating range by not swinging the first free rocker arm 37 with the others and to substantially equally apply the driving force from the third cam 34 to the intake valves 20, 20.

In the medium-speed operating range of the engine, the first driving rocker arm 37 operatively connected to the one intake valve 20 is connected to the first free rocker arm 38, and the second driving rocker arm 40 operatively connected to the other intake valve 20 is swung alone. Therefore, only three rocker arms 37, 38 and 40 of the four rocker arms 37 to 40 contribute to the opening and closing of the intake valves 20, 20 and even in this case, it is possible to relatively reduce the equivalent inertial mass of all the rocker arms. Thus, it is possible to set the spring constant of the valve springs 26, 26 at a relatively small value, which contributes to an increase in output and a reduction in fuel consumption.

Moreover, in the medium-speed operating range, the first free rocker arm 37 driven for swinging movement by the first cam 32 is connected to the first driving rocker arm 38. However, because the position of operative connection of the intake valve 20 to the first driving rocker arm 38 is offset toward the first free rocker arm 37, the deflection of the driving force provided by the first cam 32 relative to the intake valve 20 can be inhibited to the utmost, thereby preventing a partial wear of the sliding contact surfaces of the cam slipper 44 provided on the first free rocker arm 37 and the first cam 32.

Further, in the low- and medium-speed operating ranges, the intake valves 20, 20 are opened and closed with different operating characteristics. Thus, it is possible to generate a swirl within the combustion chamber 15 in the low- and medium-speed operating ranges, thereby enhancing the combustion efficiency to provide a reduction in specific fuel consumption.

Figure 11:
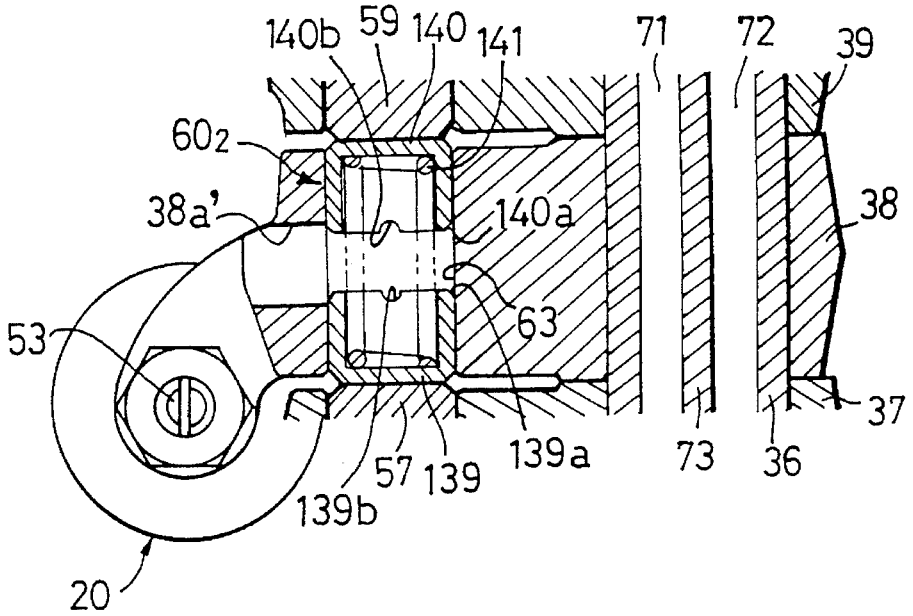
FIG. 11 is a sectional view similar to FIG. 5 but illustrating a second embodiment.
Figure 12:
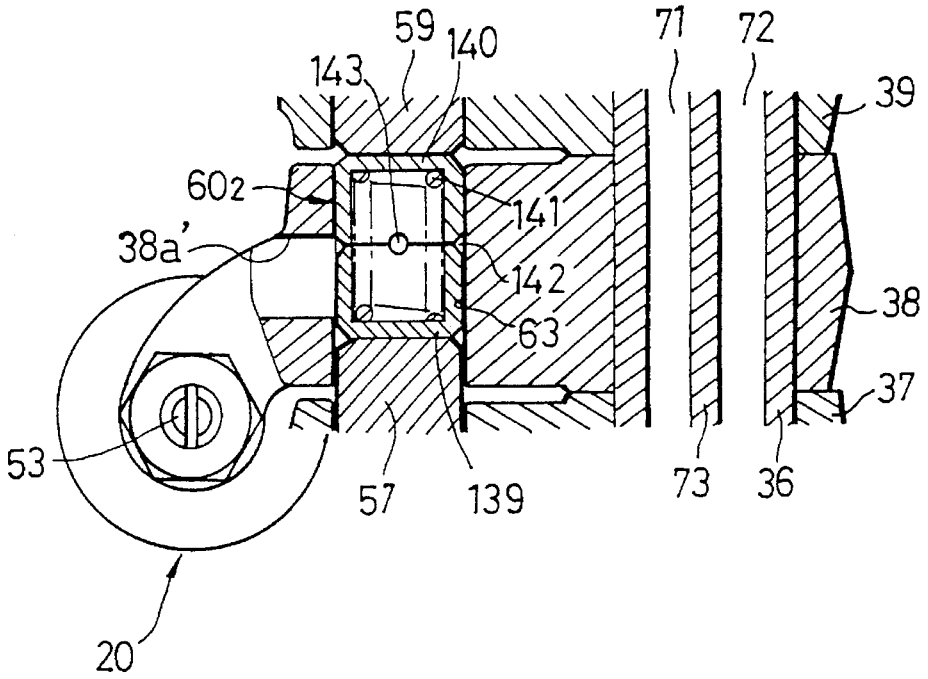
FIG. 12 is a sectional view similar to FIG. 11 illustrating the operation switching means in the operative state.

FIGS. 11 and 12 illustrate a second embodiment of the present invention, specifically modifications of the resilient mechanism $\mathbf{60_1}$, wherein portions or components corresponding to those in the first embodiment are designated by the same reference characters.

A resilient mechanism 602 provided on a first driving rocker arm 38 comprises a first retainer 139 slidably fitted in a first through guide hole 63 adjacent the first free rocker arm 37, a second retainer 140 slidably fitted in the first through guide hole 63 adjacent the second free rocker arm 39 and movable toward and away from the first retainer 139, and a return spring 141 provided under compression between both the retainers 139 and 140.

The first retainer 139 is formed into a bottomed cylinder-like configuration with a closed end in sliding contact with a medium-speed switching pin 57, and the second retainer 140 is formed into a bottomed cylinder-like configuration with a closed end in sliding contact with a second high-speed switching pin 59. The first and second retainers 139 and 140 are slidably fitted in the first through guide hole 63 with their opened ends opposed to each other, and the return spring 141 is provided under compression between the closed ends of the retainers 139 and 140.

Tapered bevels 139*a* and 140*a* are provided respectively on outer surfaces of opened ends of the first and second retainers 139 and 140 to define an annular passage 142 between the bevels themselves and an inner surface of the first through guide hole 63, when the opened ends of the retainers 139 and 140 are brought into abutment against each other, as shown in FIG. 12. Notches 139*b* and 140*b* are provided respectively at the opened ends of the first and second retainers 139 and 140 to define an air vent hole 143 leading to the annular passage 142 by cooperation with each other, when the opened ends of the retainers 139 and 140 are brought into abutment against each other, as shown in FIG. 12. Further, an air vent hole 38*a*' is provided in the first driving rocker arm 38 in a manner to lead to the annular passage 142, even when the first and second retainers 139 and 140 are moved in either direction. Thus, a closed space cannot be provided between the first and second retainers 139 and 140, and the movement of the retainers 139 and 140 toward and away from each other is smooth. Even according to the second embodiment, all the beneficial effects similar to that in the first embodiment can be provided.

Although the embodiments of the present invention have been described in detail, it will be understood that the present invention is not limited to the above-described embodiments, and various modifications in design may be made without departing from the spirit and scope of the invention defined in the claims. For example, the present invention described with respect to intake valves is applicable to a valve operating device for a pair of exhaust valves.

As discussed above, according to the present invention, it is possible to vary the operating characteristics of the pair of engine valves by the four rocker arms depending upon the low-, medium- and high-speed operating ranges of the engine, and moreover to relatively reduce the equivalent inertial mass being pivoted to provide an increase in output and a reduction in fuel consumption by interconnection of a minimal required number of the rocker arms selected from the four rocker arms in the medium- and high-speed operating ranges.

What is claimed is:

1. A valve operating device for use in an internal combustion engine for varying operating characteristics of a pair of engine valves at multi-stages depending upon operating conditions of the engine, said device comprising a cam shaft which is provided with a first cam having a profile corresponding to a medium-speed operating range of the engine, a second cam having a profile corresponding to a low-speed operating range of the engine, a third cam having a profile corresponding to a high-speed operating range of the engine, and a fourth cam having a profile corresponding to low-speed and medium-speed operating ranges of the engine, said four cams being successively arranged in the recited order on the cam shaft; a rocker shaft provided with a first free rocker arm in sliding contact with the first cam, a first driving rocker arm operatively connected to one of the engine valves and disposed adjacent one side of the first free rocker arm in sliding contact with the second cam, a second free rocker arm disposed adjacent one side of the first driving rocker arm in sliding contact with the third cam, and a second driving rocker arm operatively connected to the other engine valve and disposed adjacent one side of the second free rocker arm in sliding contact with the fourth cam, said four rocker arms being commonly carried on said rocker shaft for relative swinging movements; a medium-speed switching pin provided in the first free rocker arm for movement between a position to interconnect the first free rocker arm and the first driving rocker arm in the medium-speed operating range of the engine and a position to disconnect the first free rocker arm and the first driving rocker arm from each other in the low-speed and high-speed operating ranges of the engine; a first high-speed switching pin provided in the second driving rocker arm for movement between a position to interconnect the second driving rocker arm and the second free rocker arm in the high-speed operating range of the engine and a position to disconnect the second driving rocker arm and the second free rocker arm from each other in the low-speed and medium-speed operating ranges of the engine; a second high-speed switching pin operatively engaging the first high-speed switching pin and provided in the second free rocker arm for movement between a position to interconnect the second free rocker arm and the first driving rocker arm in the high-speed operating range of the engine and a position to disconnect the second free rocker arm and the first driving rocker arm in the low-speed and medium-speed operating ranges of the engine; and a resilient mechanism provided on the first driving rocker arm and interposed between the medium-speed switching pin and the second high-speed switching pin to exhibit a resilient force for biasing the medium-speed switching pin as well as the first and second high-speed switching pins toward their disconnecting positions, said resilient mechanism permitting the medium-speed switching pin to be fitted into the first driving rocker arm when the first and second high-speed switching pins are in their disconnecting positions as well as permitting the second high-speed switching pin to be fitted into the first driving rocker arm when the medium-speed switching pin is in its disconnecting position.

2. A valve operating device for use in an internal combustion engine for varying operating characteristics of a pair of engine valves in multi-stages depending upon operating conditions of the engine, said device comprising a cam shaft having four cams with four different cam profiles, a rocker shaft having first, second, third and fourth rocker arms pivotally mounted thereon in side-by-side relationship, each rocker arm engaging a different said cam for being pivoted by the engaged cam, said second and third rocker arms separately engaging said pair of valves for operating each of said valves in response to pivoting of said rocker arm engaging said valve, and switching means provided in said four rocker arms for selectively disconnecting all four of said rocker arms in a low-speed operating range of the engine, for selective connecting said first and second rocker arms in a medium-speed operating range of the engine and for selectively connecting said second, third and fourth rocker arms in a high speed operating range of the engine, said switching means comprising switching pins slidably mounted in cylindrical bores provided in all four of said rocker arms, said switching pins including a medium-speed switching pin in said first rocker arm for movement to a position to interconnect said first rocker arm and said second rocker arm in the medium-speed operating range of the engine, a first high-speed switching pin in said third rocker arm for movement to a position to interconnect said third rocker arm and said fourth rocker arm in the high-speed operating range of the engine, and a second high-speed switching pin adjacent and operatively connected to said first high-speed switching pin and positioned in said fourth rocker arm for movement to a position to interconnect said fourth rocker arm and said second rocker arm in the high-speed operating range of the engine.

3. The valve operating device of claim 2 wherein said cylindrical bores in said rocker arms are disposed parallel to said rocker shaft and are aligned when all four said rocker arms are in a non-operating position without being pivoted by said cams, and means are provided for selectively supplying hydraulic pressure to selected ones of said cylindrical bores to cause sliding movement of at least one of said switching pins for selectively connecting and disconnecting adjacent said rocker arms for said low-speed, medium-speed and high-speed operation of the engine.

4. The valve operating device of claim 3 wherein resilient means is provided in one of said cylindrical bores for resiliently urging said switching pins to positions for disconnecting all of said rocker arms when said hydraulic pressure is released.

5. The valve operating device of claim 2 wherein said switching means includes a resilient mechanism in said cylindrical bore in said second rocker arm and interposed between said medium-speed switching pin and said second high-speed switching pin to exhibit a resilient force for biasing the medium-speed switching pin as well as the first and second high-speed switching pins toward their disconnecting positions.

6. The valve operating device of claim 3 wherein said switching means includes a resilient mechanism in said cylindrical bore in said second rocker arm and interposed between said medium-speed switching pin and said second high-speed switching pin to exhibit a resilient force for biasing the medium-speed switching pin as well as the first and second high-speed switching pins toward their disconnecting positions.

* * * * *